US011577420B2

(12) United States Patent
Parisse et al.

(10) Patent No.: US 11,577,420 B2
(45) Date of Patent: Feb. 14, 2023

(54) QUICK-CHANGE CUTTING BLADE ASSEMBLY AND METHOD

(71) Applicant: Ranpak Corp., Concord Township, OH (US)

(72) Inventors: Rémi Parisse, Dijon (FR); Uwe Klarner, Dijon (FR); Jean-Yves Sia, Dijon (FR)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 16/964,498

(22) PCT Filed: Jan. 23, 2019

(86) PCT No.: PCT/US2019/014714
§ 371 (c)(1),
(2) Date: Jul. 23, 2020

(87) PCT Pub. No.: WO2019/147645
PCT Pub. Date: Aug. 1, 2019

(65) Prior Publication Data

US 2020/0406492 A1 Dec. 31, 2020

Related U.S. Application Data

(60) Provisional application No. 62/620,789, filed on Jan. 23, 2018.

(51) Int. Cl.
*B26D 7/26* (2006.01)
*B26B 5/00* (2006.01)

(52) U.S. Cl.
CPC ..... *B26D 7/2621* (2013.01); *B26B 5/005* (2013.01)

(58) Field of Classification Search
CPC ..... B26B 5/005; B26B 5/006; B26B 5/00; B26D 1/285; B26D 7/2642; B26D 15/105
See application file for complete search history.

(56) References Cited

U.S. PATENT DOCUMENTS 930,149 A * 8/1909 Brown ..... B26B 5/00 30/330
1,064,545 A * 6/1913 Rote ..... B24D 15/105 30/331

(Continued)

FOREIGN PATENT DOCUMENTS

CA 2260109 A1 11/1999
CN 201095113 Y 8/2008

(Continued)

OTHER PUBLICATIONS

International Search Report and Written Opinion dated May 9, 2019 for PCT/US2019/014714.

(Continued)

*Primary Examiner* — Ghassem Alie
*Assistant Examiner* — Samuel A Davies
(74) *Attorney, Agent, or Firm* — Renner, Otto, Boisselle & Sklar, LLP

(57) ABSTRACT

A quick-change cutting assembly includes a base having a support surface for supporting a cutting blade, a clamping arm having a clamping surface, a spring interposed between the base and the clamping arm, and a pivot defining a pivot axis between the spring and the clamping surface that couples the clamping arm to the base. The spring biases the clamping surface toward the support surface and a cutting blade therebetween. The clamping arm is pivotable between a closed position where the clamping surface is parallel to the support surface and an open position removed from the closed position where the clamping surface is spaced further from the support surface. The cutting assembly further (Continued)

includes a locking pin transverse the direction of biasing action of the spring that connects the clamping arm to the base to prevent the clamping arm from pivoting relative to the base when in the closed position.

8 Claims, 9 Drawing Sheets

(56) References Cited

U.S. PATENT DOCUMENTS 1,284,808 A * 11/1918 Steers ..... B26B 5/006 30/353
1,493,372 A * 5/1924 Moon ..... B26B 5/006 30/169
1,601,272 A * 9/1926 Velarde ..... B24D 15/105 30/338
1,607,160 A * 11/1926 Leonard ..... B24D 15/105 30/330
1,765,812 A * 6/1930 White ..... B26B 5/006 30/338
1,774,680 A * 9/1930 Thomas ..... B26B 5/006 30/336
1,936,016 A * 11/1933 Hay ..... B24D 15/105 451/316
1,971,867 A * 8/1934 McMullen ..... B24D 15/105 451/377
2,003,497 A * 6/1935 Tewelow ..... B26B 5/006 30/329
2,031,455 A * 2/1936 Black ..... B26B 21/32 30/57
2,061,900 A * 11/1936 Easton ..... B24D 15/105 30/331
2,105,663 A * 1/1938 Laverty ..... B26B 5/006 30/162
2,143,053 A * 1/1939 Collver ..... B26B 5/006 30/338
2,161,403 A * 6/1939 Ashworth ..... B26B 21/30 30/58
2,176,830 A * 10/1939 Wyper, Sr. ..... B26B 5/006 30/329
2,241,608 A * 5/1941 Lurie ..... B26B 5/006 15/236.01
2,283,721 A * 5/1942 Brockhurst ..... B26B 21/50 30/36
2,357,379 A * 9/1944 Bradley ..... B26B 5/00 30/294
2,409,203 A * 10/1946 Gale ..... B26D 3/02 83/614
2,437,928 A * 3/1948 Bennett ..... B26B 5/006 30/338
3,257,726 A * 6/1966 Longobardi ..... B24D 15/105 D8/71
4,700,600 A 10/1987 Pickett
5,168,630 A * 12/1992 Weber ..... B26B 5/00 30/125
5,211,097 A 5/1993 Grasselli
6,039,843 A * 3/2000 Wight ..... D21F 1/483 162/352
6,264,282 B1 * 7/2001 Gaumont ..... E04F 21/20 15/236.01
7,028,406 B2 * 4/2006 Polei ..... B26B 5/00 30/162
7,814,608 B1 * 10/2010 Catello ..... A47L 13/022 15/236.01
7,930,830 B2 * 4/2011 Gringer ..... B23D 79/10 30/294
8,701,294 B2 * 4/2014 Bruce ..... B25G 1/01 30/236
8,726,776 B2 * 5/2014 O'Banion ..... B27G 19/08 83/478
9,981,396 B1 * 5/2018 Rafii ..... B26B 27/005
2002/0104178 A1 * 8/2002 Truan ..... B62D 49/04 15/98
2004/0143924 A1 * 7/2004 Salmon ..... B26B 5/00 15/236.1
2004/0221701 A1 * 11/2004 Chang ..... B27B 5/29 83/468.2
2007/0294850 A1 * 12/2007 Murphy ..... B25G 3/24 15/236.01
2009/0199411 A1 * 8/2009 van Deursen ..... A47L 13/022 30/169
2009/0241346 A1 * 10/2009 Bilenski ..... B26B 5/005 30/353
2014/0345147 A1 * 11/2014 Frazer ..... B26B 5/00 30/336
2016/0144519 A1 * 5/2016 Hahn ..... B26B 21/225 30/50
2017/0348863 A1 * 12/2017 Kommer ..... B26B 9/00
2018/0370054 A1 * 12/2018 Baird, Jr. ..... B26B 29/06
2020/0130219 A1 * 4/2020 Puntoni ..... B26D 1/28

FOREIGN PATENT DOCUMENTS

DE 102007036688 A1 11/2008
EP 0735357 A1 10/1996
EP 2489483 A1 8/2012
JP S6028241 U 2/1985
JP S60101062 U 7/1985
JP 60117081 8/1985
JP 6226050 Y2 7/1987
JP 2008229077 A 10/2008

OTHER PUBLICATIONS

International Preliminary Report on Patentability dated Jul. 28, 2020, for International Patent Application No. PCT/US2019/014714.
Communication pursuant to Article 94(3) EPC dated Aug. 12, 2022, for corresponding European Patent Application No. 19704697.2.
Notification of the Second Office Action dated Nov. 22, 2021, for corresponding Chinese Patent Application No. 201980009686.1.
Notice of Reason(s) for Rejection dated Nov. 8, 2022, for corresponding Japanese Patent Application No. 2020-540587.

* cited by examiner

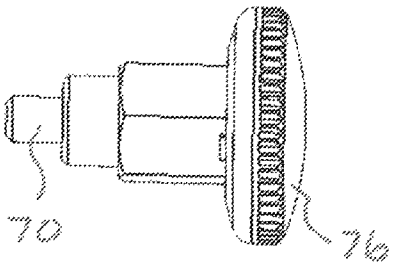
FIG. 9
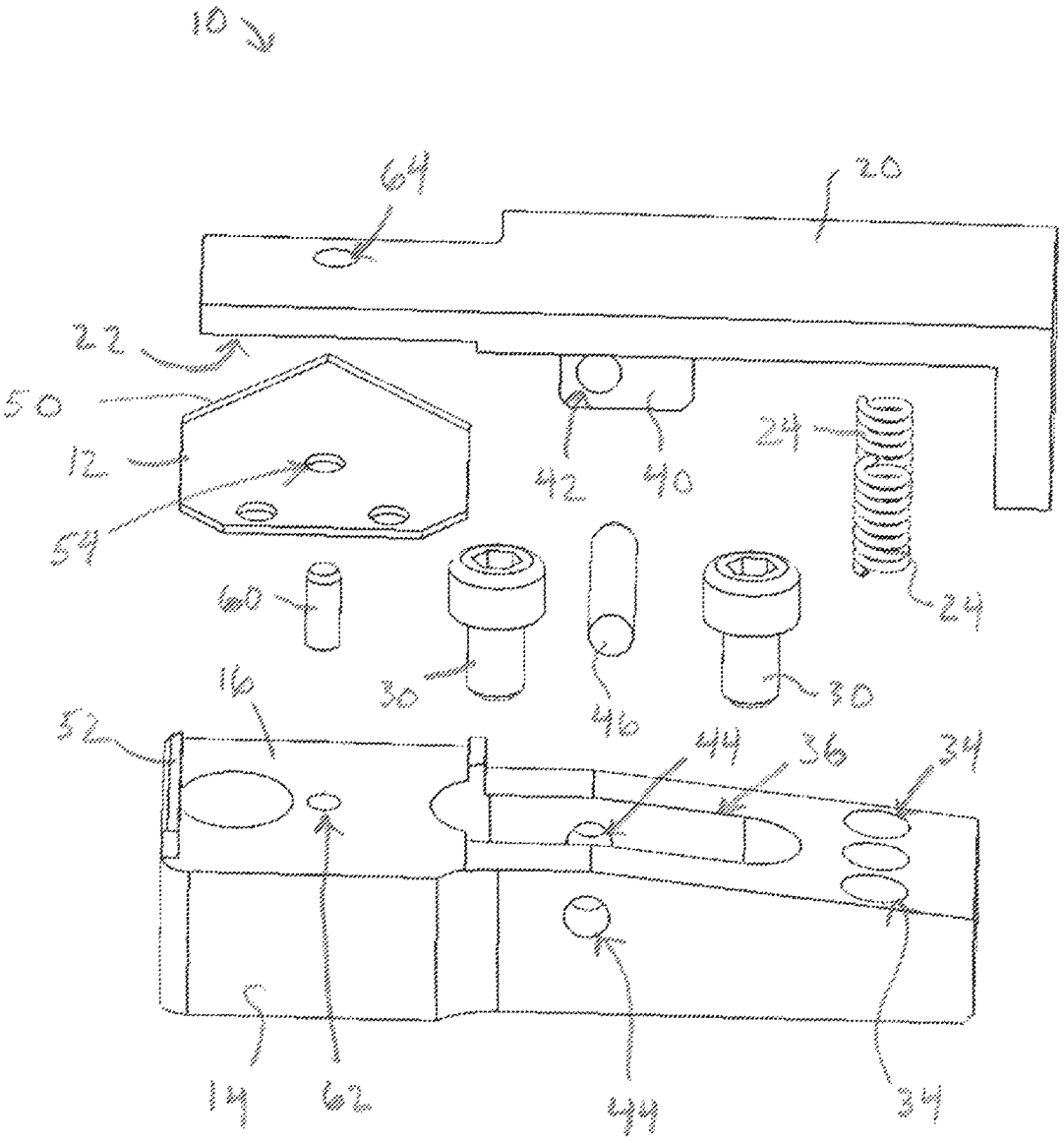

QUICK-CHANGE CUTTING BLADE ASSEMBLY AND METHOD

RELATED APPLICATIONS

This application is a national phase of International Application No. PCT/US2019/014714, filed Jan. 23, 2019, and published in the English language, and which claims priority to U.S. Application No. 62/620,789, filed Jan. 23, 2018, both of which are hereby incorporated herein by reference in their entireties.

FIELD OF THE INVENTION

The present invention relates to an assembly for supporting a cutting blade that facilitates quick replacement of the cutting blade as needed.

BACKGROUND

Cardboard containers used for shipping may be partially erected and then the partially-erected container may be cut to form a container having a desired height. The cutting operation uses a cutting blade that must be sharpened or replaced over time.

SUMMARY

The present invention provides an assembly for supporting a cutting blade during a cutting operation while also facilitating quick replacement of the cutting blade as needed. While current assemblies hold the cutting blade securely during use, existing assemblies generally cannot be quickly released to remove and replace the cutting blade.

The following paragraphs paraphrase the claims.

More particularly, the present invention provides a quick-change cutting assembly including a base having a support surface for supporting a cutting blade, a clamping arm having a clamping surface, a spring interposed between the base and the clamping arm, and a pivot between the spring and the clamping surface coupling the clamping arm to the base. The spring biases the clamping surface toward the support surface for the cutting blade.

In one or more embodiments of the cutting assembly, (a) the clamping surface is parallel to the support surface; and (b) the clamping surface is pivotable about a pivot axis defined by the pivot between a closed position where the clamping surface is parallel to the support surface and an open position removed from the closed position where the clamping surface is spaced further from the support surface. The cutting assembly may further include a locking pin transverse the biasing action of the spring that connects the clamping arm to the base to prevent the clamping arm from pivoting relative to the base when the clamping arm is in the closed position.

The cutting assembly might include a blade holder protruding from the support surface to minimize movement of a cutting blade in a direction parallel to the support surface. For example, the clamping arm may include an aperture and the blade holder may extend into the aperture in the clamping arm when the clamping arm is in the closed position.

In one or more embodiments, the support surface is planar and the blade holder protrudes beyond a periphery of the support surface.

The cutting assembly may include a cutting blade supported on the support surface. And the cutting blade may include an aperture configured to receive a retaining pin protruding from the support surface.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

BRIEF DESCRIPTION OF THE DRAWINGS

FIG. 9 is an exploded view of the quick-change cutting blade assembly of FIG. 1.

DETAILED DESCRIPTION

Figure 1:
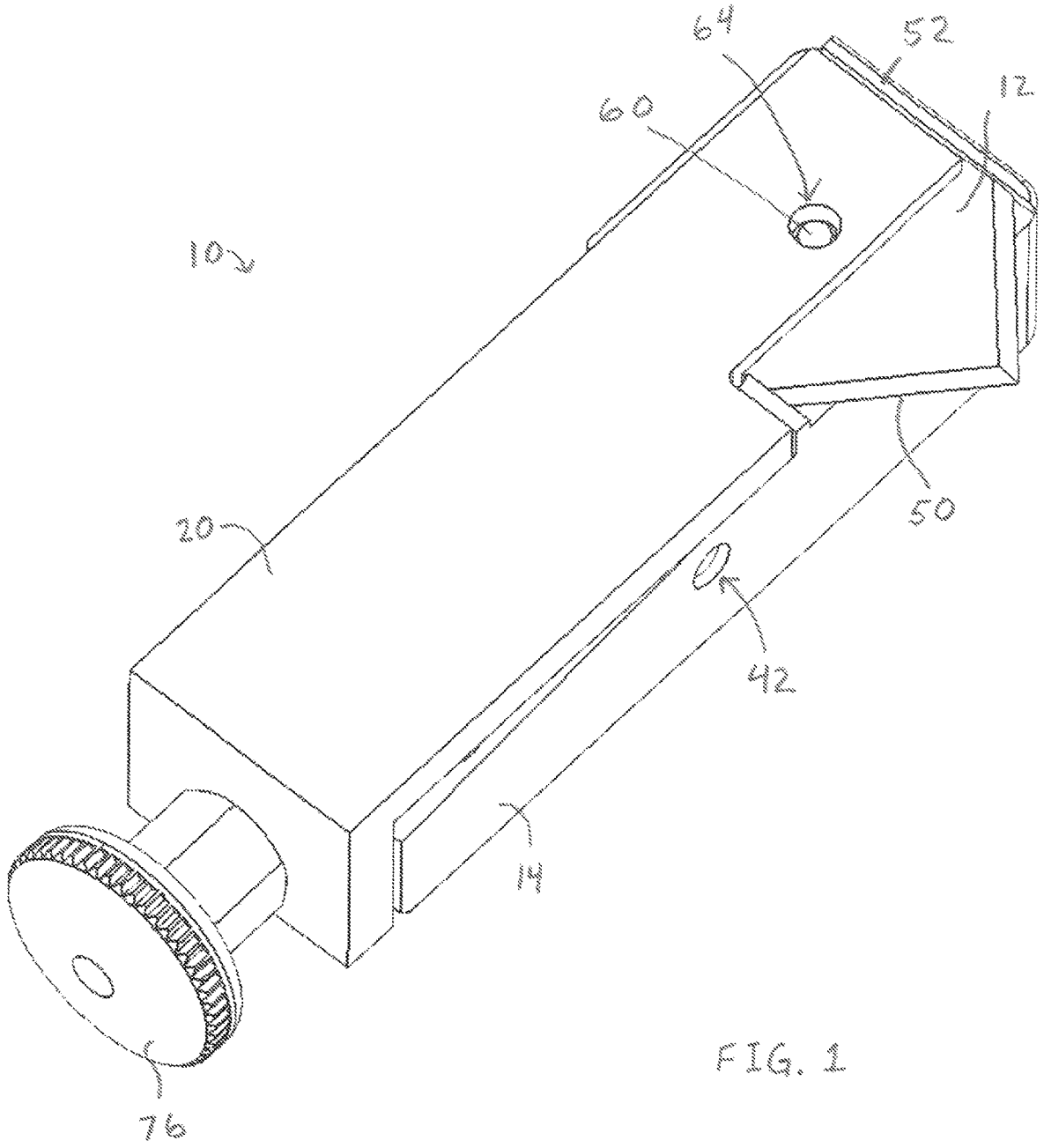
FIG. 1 is a perspective view of an exemplary quick-change cutting blade assembly provided in accordance with the present invention.
Figure 2:
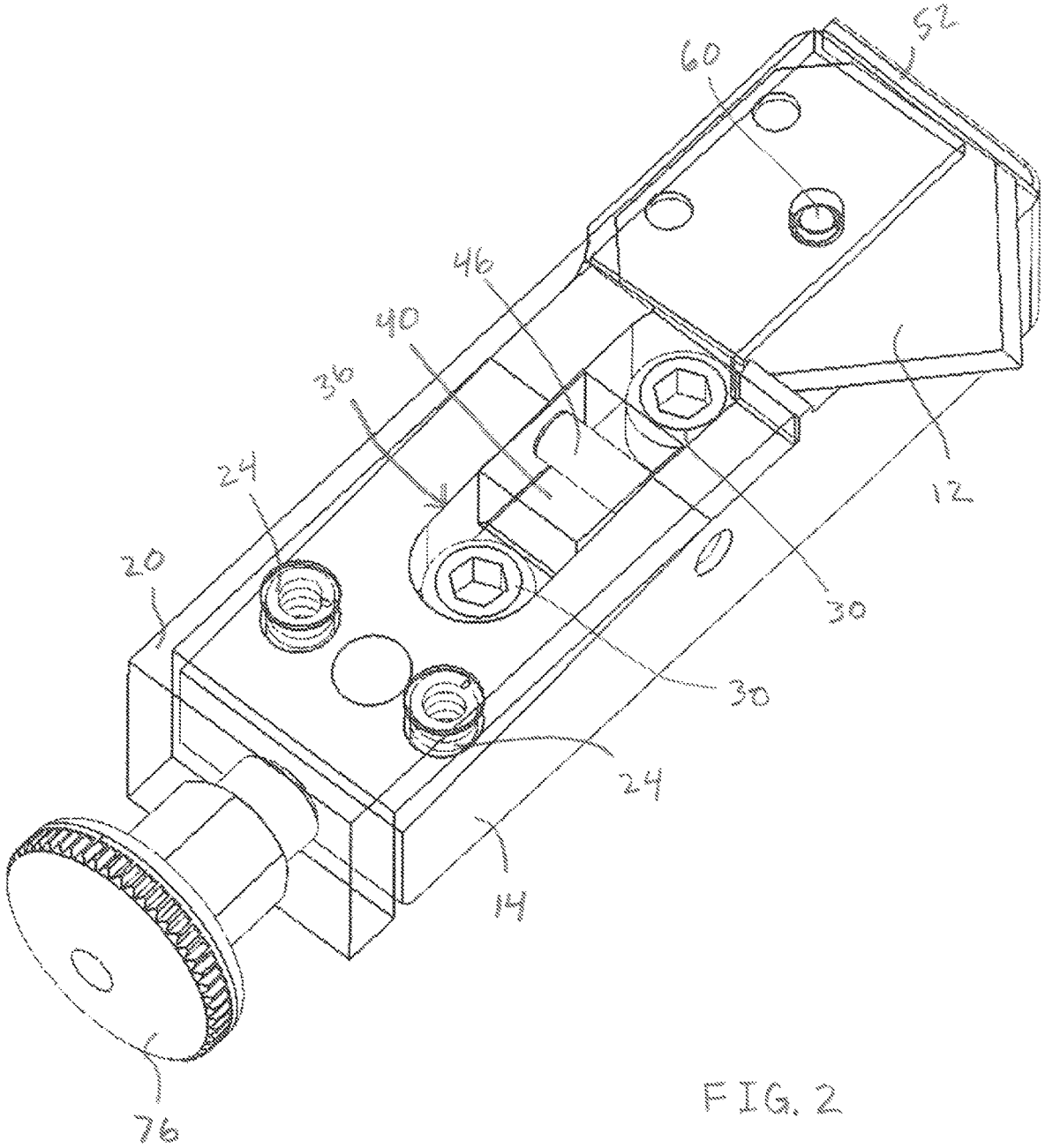
FIG. 2 is a perspective view of the quick-change cutting blade assembly of FIG. 1, with a portion rendered translucent to better illustrate the internal structure and components.
Figure 3:
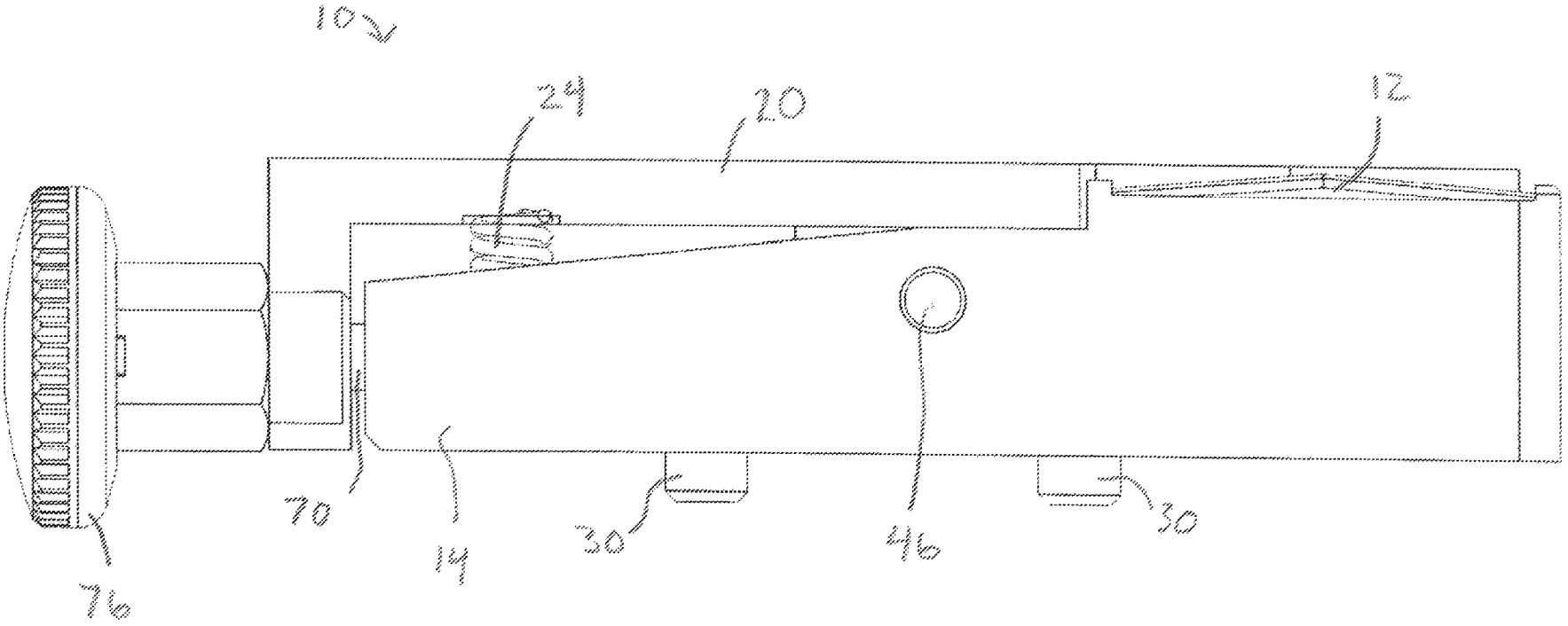
FIG. 3 is a side elevation view of the quick-change cutting blade assembly of FIG. 1.
Figure 4:
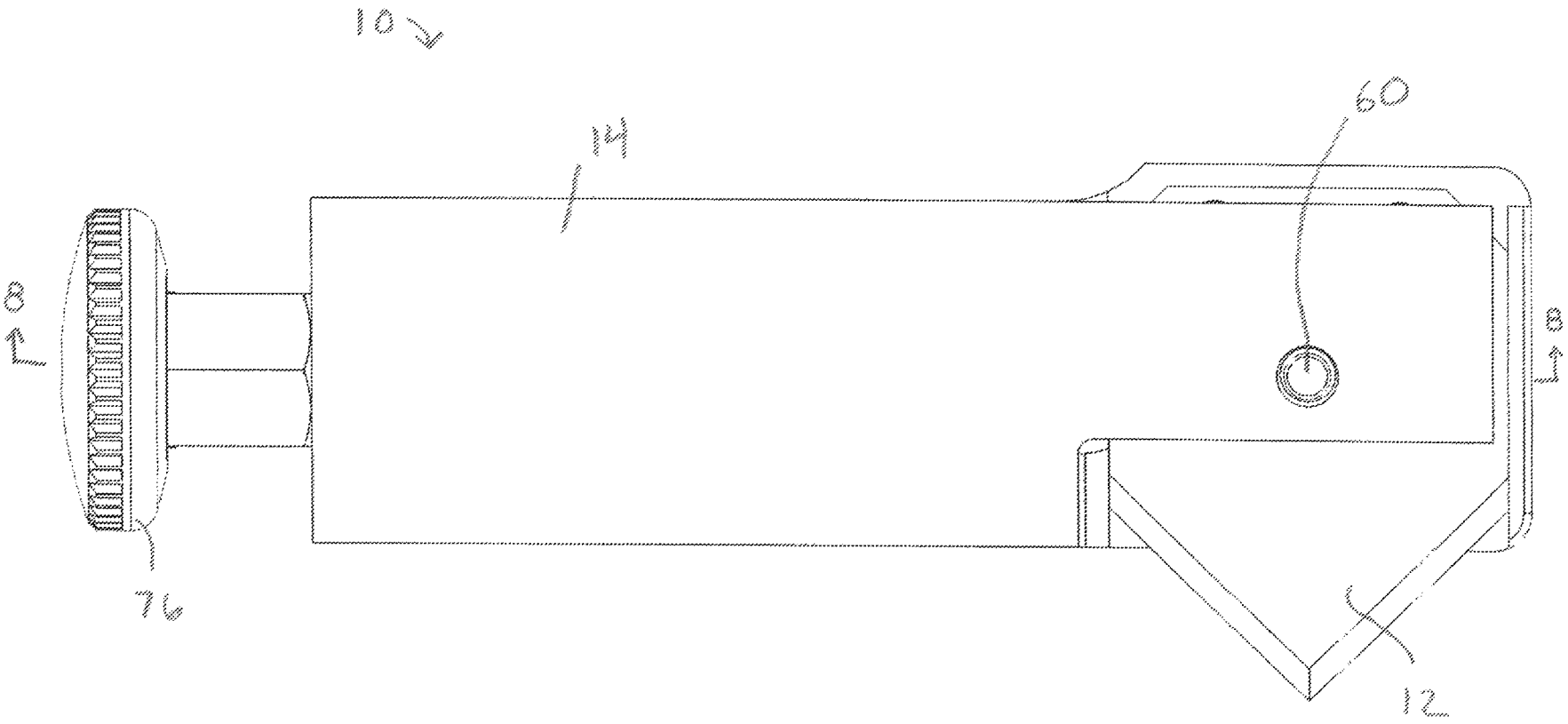
FIG. 4 is a top view of the quick-change cutting blade assembly of FIG. 1.
Figure 5:
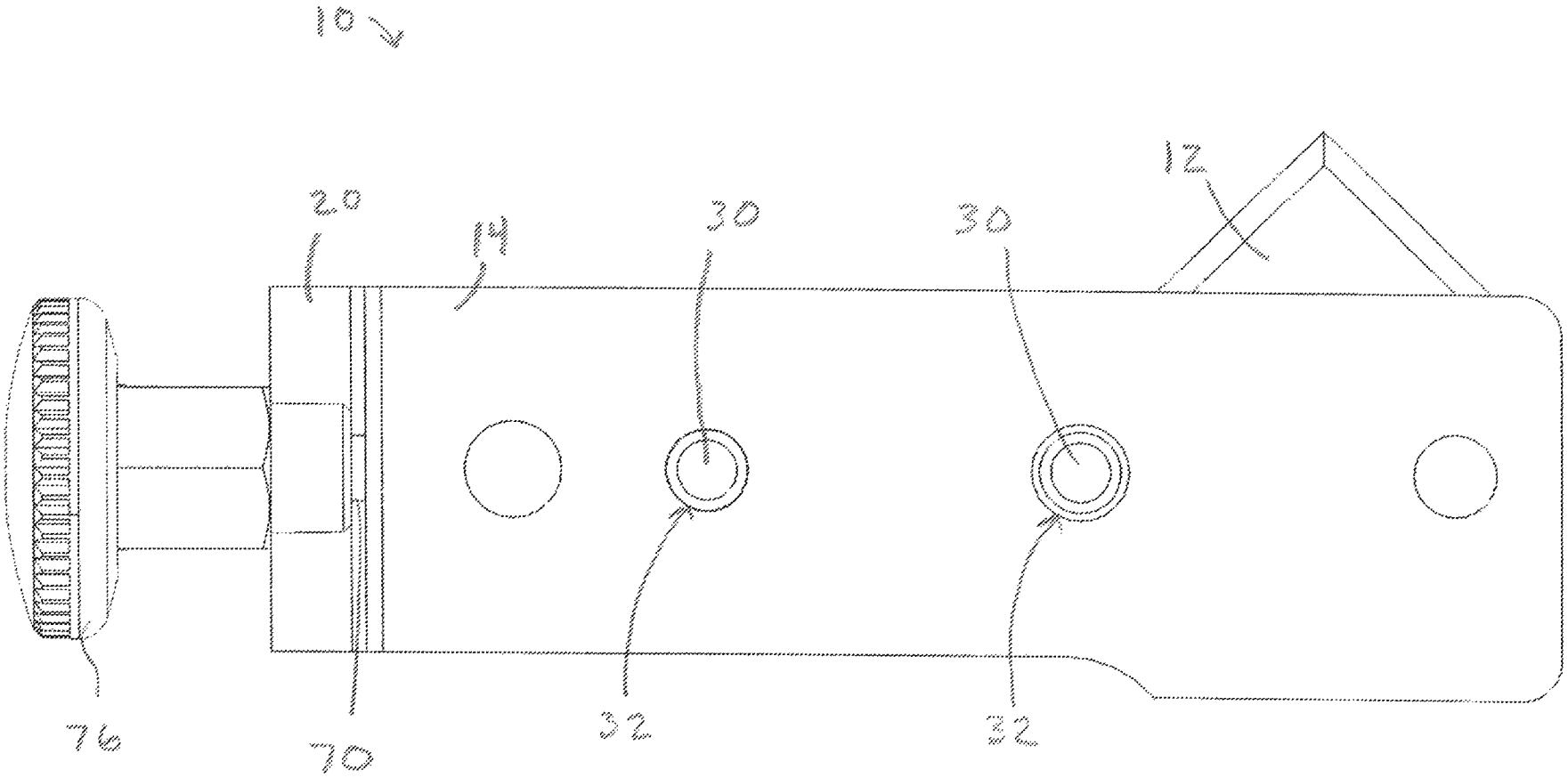
FIG. 5 is a bottom view of the quick-change cutting blade assembly of FIG. 1.
Figure 6:
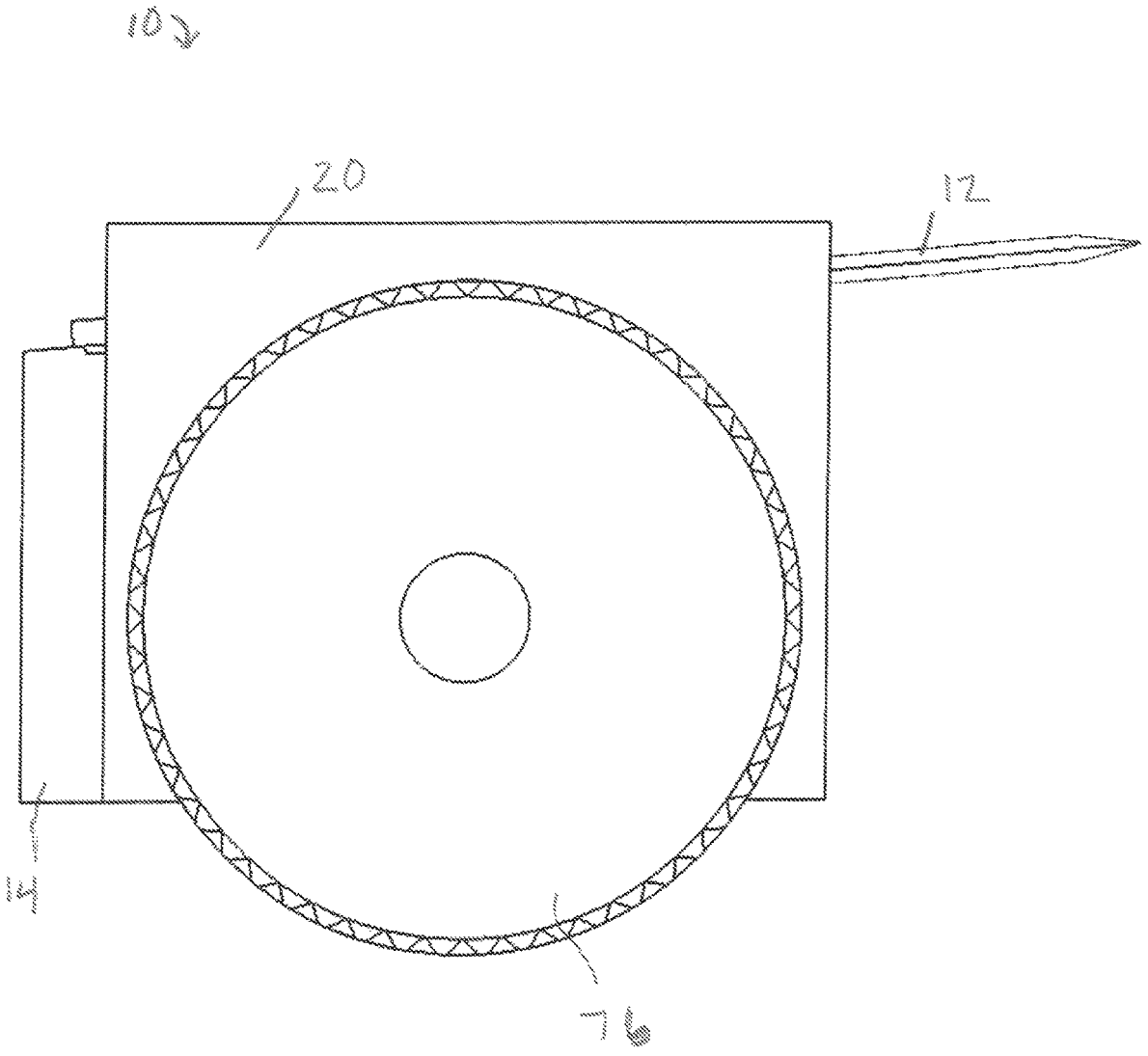
FIG. 6 is a left side elevation view of the quick-change cutting blade assembly of FIG. 1.
Figure 7:
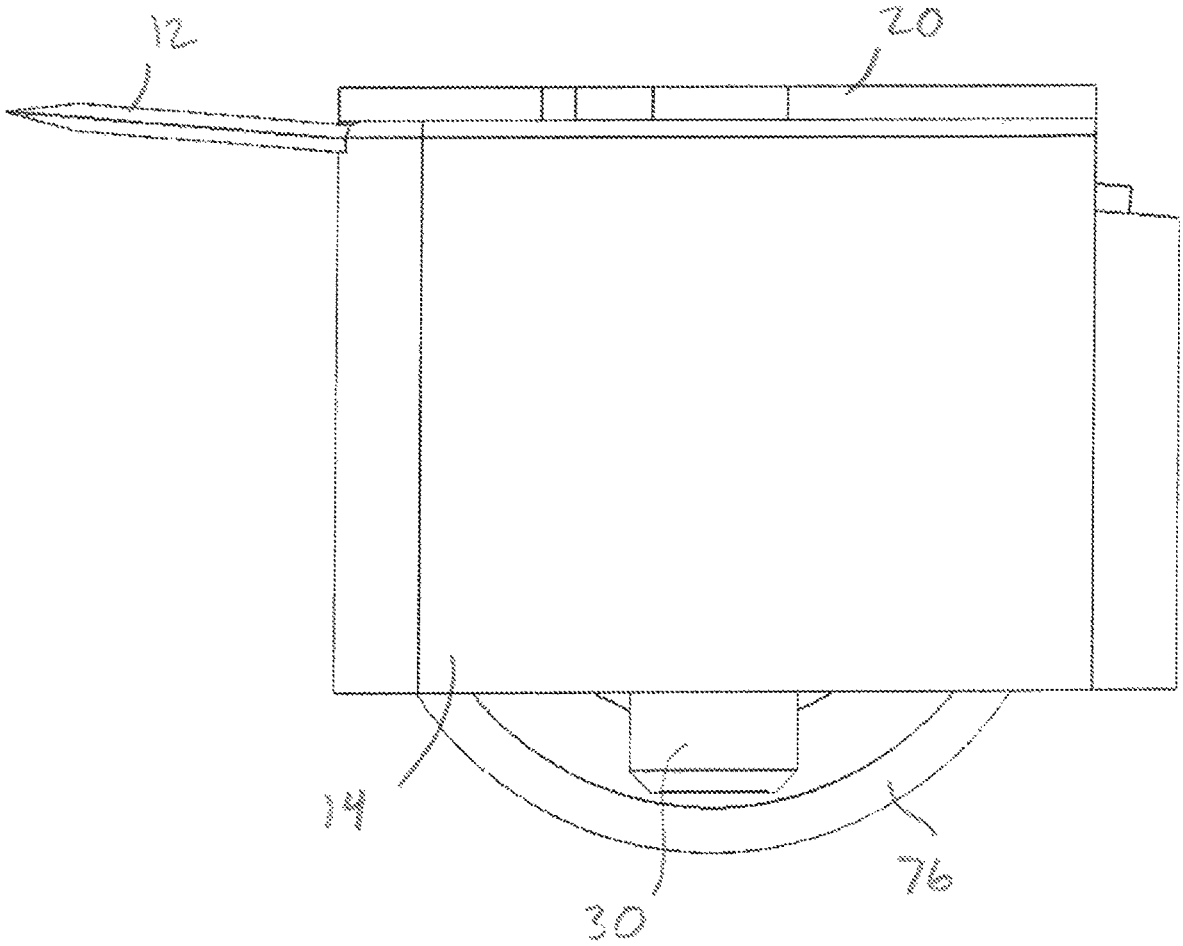
FIG. 7 is a right side elevation view of the quick-change cutting blade assembly of FIG. 1.
Figure 8:
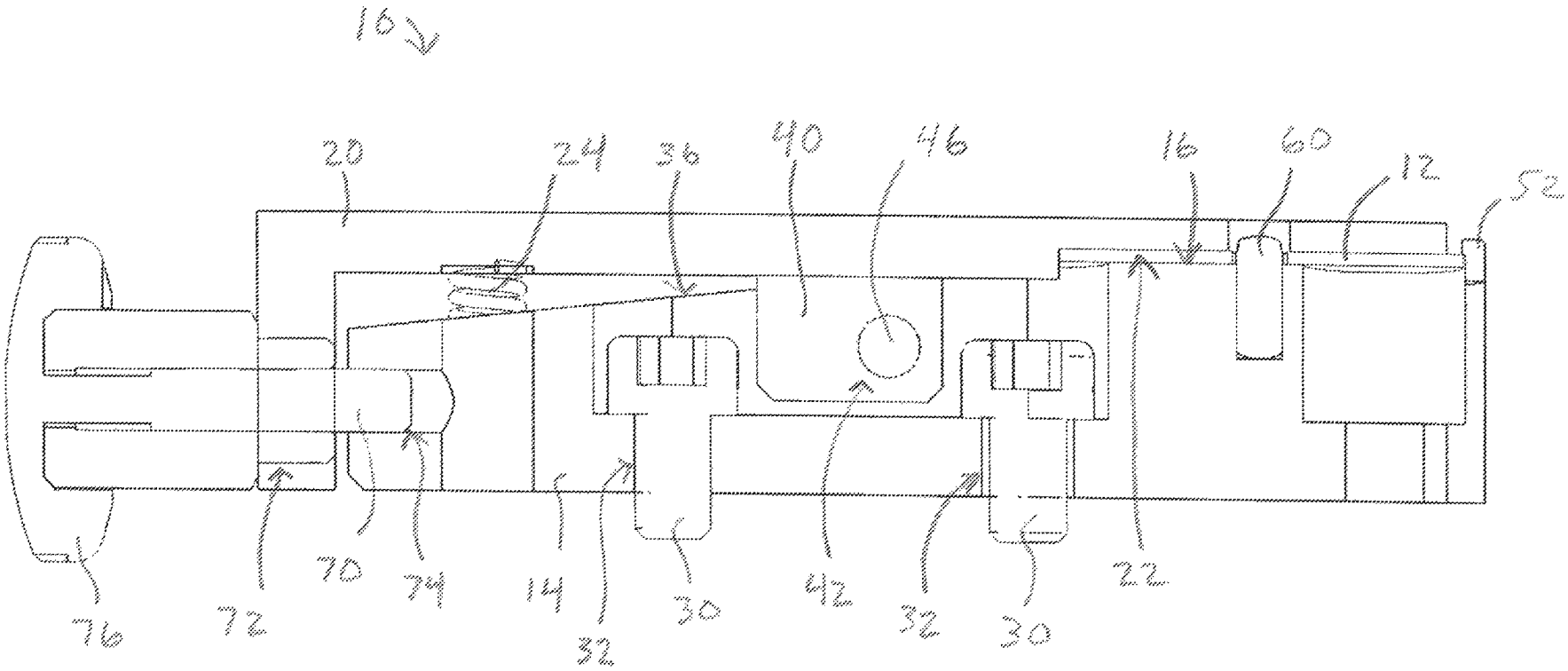
FIG. 8 is a cross-sectional view of the quick-change cutting blade assembly of FIG. 1 as seen along line 8-8 of FIG. 4.

As mentioned above, the present invention provides an assembly 10 for supporting a cutting blade 12 during a cutting operation while also facilitating quick replacement of the cutting blade 12 as needed.

The quick-change cutting assembly 10 includes a base 14 having a support surface 16 for supporting a cutting blade 12, a clamping arm 20 having a clamping surface 22 facing the support surface 16, a spring 24 interposed between the base 14 and the clamping arm 20, and a pivot 26 between the spring 24 and the clamping surface 22 that also pivotally couples the clamping arm 20 to the base 14. The spring 24 biases the clamping surface 22 against the support surface 16 for the cutting blade 12.

The illustrated base 14 further includes means for mounting the cutting assembly 10 to another structure, in the form of a pair of mounting bolts 30 that may be received in and extend through respective through-holes 32 in the base 14.

The illustrated cutting assembly 10 also includes more than just one spring 24, but a pair of springs 24, which are received in respective spring-capturing pockets 34 in the base 14 that help to retain the springs 24 in place relative to the base 14, the clamping arm 20, and the pivot 26.

The clamping arm 20 has a pivot block 40 that extends outwardly and is received in a recess 36 in the base 14. The pivot block 40 includes a transverse through-passage 42 that aligns with a transverse passage 44 in the base 14 into opposing sides of the recess 36 for receipt of a pivot pin 46 that extends through through-passage 42 in the pivot block 40 and is received in opposing portions of the transverse passage 44 to engage the base 14 on both sides of the recess 36. The pivot pin 46 is cylindrical and defines a pivot axis about which the clamping arm 20 pivots relative to the base 14.

Thanks to the pivot pin's 46 engagement with the base 14 and the clamping arm 20, this configuration allows the clamping arm 20 to pivot about the pivot axis defined by the pivot pin 46 between a closed position where the clamping surface 22 is parallel to the support surface 16 and an open position removed from the closed position where the clamping surface 22 is spaced further from the support surface 16. In the closed position, the clamping surface 22 on the clamping arm 20 is parallel to the support surface 16 on the base 14, spaced apart approximately the thickness of the cutting blade 12 to be clamped in between.

An exemplary cutting blade 12 is planar, with a cutting edge 50 protruding from between the support surface 16 and the clamping surface 22. A blade holder protrudes from the support surface 16 to minimize or eliminate movement of the cutting blade 12 in a direction parallel to the support surface 16. In the illustrated embodiment, protruding portions 52 of the base 14 around the periphery of the support surface 16 further support the cutting blade 12 and prevent or minimize movement of the cutting blade 12 in directions parallel to the support surface 16. In addition, a retaining pin 60 protrudes from the support surface 16 and passes through an aperture 54 in the cutting blade 12 to further secure the cutting blade 12 in place. The clamping surface 22 also may have an aperture 62 for receipt of an end of the retaining pin 60. The opposing end of the retaining pin 60 may be received in an aperture 64 in the support surface 16, or the retaining pin 56 may be integrally formed with the base 14.

Alternatively, the retaining pin 60 may be permanently secured to or integrally formed in the clamping arm 20 and received in an aperture 64 in the support surface 16.

The cutting assembly 10 may further includes a locking pin 70 that extends in a direction transverse the direction of action of the spring 24, to lock the clamping arm 20 in the closed position against the action of the spring or springs 24. The locking pin 70 passes through an aperture 72 in the clamping arm 20 into an aligned bore 74 in the base 14 to prevent relative movement of the clamping arm 20 relative to the base 14 in a direction transverse the locking pin 70. In the illustrated embodiment the locking pin 70 is coupled to a knob 76 that facilitates gripping the locking pin 70 for insertion or removal to permit or prevent relative movement between the clamping arm 20 and the base 14. In the illustrated embodiment, the clamping arm 20 has an L-shape cross-section and the locking pin 70 extends from one end of the L-shape into an end of the base 14, transverse and perpendicular to the pivot pin 46 and pivot axis. Alternatively, the clamping arm 20 may have a portion that extends over a front or back side of the base 14, perpendicular to the corresponding end of the L-shape in the illustrated embodiment, with the locking pin 70 extending into a front or back side of the base 14 in a direction parallel to the pivot pin 46 and the pivot axis.

The cutting assembly 10 may be sold with or without a cutting blade 12 supported on the support surface 16, but is intended to be used to support a cutting blade 12 for a cutting operation.

In summary, the present invention provides a quick-change cutting assembly 10 that includes a base 14 having a support surface 16 for supporting a cutting blade 12, a clamping arm 20 having a clamping surface 22, a spring 24 interposed between the base 14 and the clamping arm 20, and a pivot 28 defining a pivot axis between the spring 24 and the clamping surface 22 that couples the clamping arm 20 to the base 14. The spring 24 biases the clamping surface 22 toward the support surface 16 and a cutting blade 12 therebetween. The clamping arm 20 is pivotable between a closed position where the clamping surface 22 is parallel to the support surface and an open position removed from the closed position where the clamping surface 22 is spaced further from the support surface 16. The cutting assembly 10 further includes a locking pin 70 transverse the direction of action of the spring 24 that connects the clamping arm 20 to the base 14 to prevent the clamping arm 20 from pivoting relative to the base 14 when in the closed position.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

The invention claimed is:

1. A quick-change cutting assembly, comprising:

a base having a support surface for supporting a cutting blade;

a clamping arm having a clamping surface;

a spring interposed between the base and the clamping arm;

a pivot between the spring and the clamping surface coupling the clamping arm to the base, wherein the pivot defines a pivot axis and the clamping surface is pivotable about the pivot axis between a closed position where the clamping surface is parallel to the support surface and an open position removed from the closed position where the clamping surface is spaced further from the support surface, and the spring biases the clamping surface toward the support surface for the cutting blade;

a locking pin extending transverse to the biasing action of the spring that connects the clamping arm to the base to prevent the clamping arm from pivoting relative to the base when the clamping arm is in the closed position, wherein the locking pin extends through an aperture in the clamping arm into an aligned bore in the base; and a blade holder protruding from the support surface and extending past the clamping surface when the clamping arm is in the closed position to minimize movement of a cutting blade in a direction parallel to the support surface.

2. A cutting assembly as set forth in claim 1, wherein the clamping arm including a second aperture and the blade holder extends into the second aperture in the clamping arm when the clamping arm is in the closed position.

3. A cutting assembly as set forth in claim 1, wherein the support surface is planar and the blade holder protrudes beyond a periphery of the support surface.

4. A cutting assembly as set forth in claim 1, comprising a cutting blade supported on the support surface.

5. A cutting assembly as set forth in claim 4, wherein a retaining pin protruding from the support surface, and the cutting blade includes an aperture configured to receive the retaining pin.

6. A cutting assembly as set forth in claim 4, wherein the cutting blade extends beyond the support surface and the clamping surface in a direction parallel to the pivot axis.

7. A cutting assembly as set forth in claim 1, wherein the blade holder includes a protruding portion extending from the support surface that extends past the clamping surface when the clamping arm is in the closed position, and the support surface for the cutting blade is interposed between the protruding portion and the pivot axis.

8. A cutting assembly as set forth in claim 7, wherein the clamping arm includes a proximal portion and a distal portion with the pivot axis interposed between the proximal portion and the distal portion, and the spring acts on the proximal portion of the clamping arm; and wherein the protruding portion extending from the support surface is located beyond a distal end of the distal portion of the clamping arm when the clamping arm is in the closed position.

* * * * *